United States Patent [19]

Penick et al.

[11] 4,336,664

[45] Jun. 29, 1982

[54] PROMOTIONAL PUZZLE

[75] Inventors: Ib Penick, Prospect Heights; John K. Volkert, Northfield, both of Ill.

[73] Assignee: Compak System, Inc., Northfield, Ill.

[21] Appl. No.: 815,657

[22] Filed: Jul. 14, 1977

[51] Int. Cl.[3] ..... G09F 7/12; G09F 19/00; A63F 9/10

[52] U.S. Cl. ..... 40/594; 40/615; 40/312; 273/157 R

[58] Field of Search ..... 40/584, 594, 615, 312; 273/157 R; D34/15 M; D21/105

[56] References Cited

U.S. PATENT DOCUMENTS

| | | | |
|---|---|---|---|
| D. 217,778 | 6/1970 | Herstam | D34/15 M |
| 669,445 | 3/1901 | Morey | 273/157 R |
| 1,217,632 | 2/1917 | Pritchard | 273/157 R |
| 1,325,369 | 12/1919 | O'Brien | 273/157 R |
| 2,022,319 | 11/1935 | Meyercord | 273/157 R |
| 2,353,037 | 7/1944 | Irwin | 273/157 R |
| 3,171,540 | 3/1965 | Douglas | 273/157 R |
| 3,433,485 | 3/1969 | Renn et al. | 273/157 R |
| 3,512,780 | 5/1970 | Allison | 273/157 R |
| 3,550,945 | 12/1970 | Resnick | 273/157 R |
| 3,811,203 | 5/1974 | Mayfield | 273/157 R |
| 3,923,307 | 12/1975 | Sukys et al. | 273/157 R |

*Primary Examiner*—Robert Peshock
*Assistant Examiner*—Michael J. Foycik
*Attorney, Agent, or Firm*—Fitch, Even, Tabin, Flannery & Welsh

[57] ABSTRACT

An advertising or promotional item is made by preparing a visual advertising or promotional message and cutting it into a plurality of separate interfitting pieces, substantially all of which have the same shape and size as at least one other piece. After interchanging the locations of most of the pieces to scramble them and hide the message, the scrambled relationship visual image is printed upon sheet material and then die-cut to form the original message pieces arranged in scrambled relationship, whereby the recipient must rearrange the pieces to discover the hidden, advertising or promotional message. Preferably, the message region is divided into three or more substantially identical sections. The die-cut sheet material may be laminated with pressure-sensitive adhesive to a backing sheet having a release coating and may be applied to or formed as a part of the sidewall of a container.

3 Claims, 3 Drawing Figures

25

PROMOTIONAL PUZZLE

The present invention relates to advertising or promotional items and more particularly to an item of this character which is distributed in a form to present an incomprehensible message and thus requires some action by the recipient in order to discover the intended message.

So-called "jigsaw" puzzles have long been made by die-cutting a printed picture into a plurality of interfitting or interlocking pieces in order to present the challenging task of reassembling the pieces to recreate the picture. Such puzzles are sometimes sold in their assembled form, often enclosed within a transparent wrapping, so that the buyer, to test his skill, must first disassemble and jumble the pieces before beginning assembly. Perhaps more often these puzzles are sold disassembled and jumbled within a box that bears a miniature version of the picture that will be created upon reassembly. Many such jigsaw puzzles are made in a manner so that a single piece will fit in only one location; however, there have been puzzles made and sold wherein a certain limited number of pieces could be interchanged in location.

The present invention provides a novel advertising or promotional item which is fabricated and distributed with the separate pieces arranged in a scrambled formation so that it is necessary for the recipient to first individually separate the interfitting pieces and then rearrange them to read the message which will be at least somewhat pictorial. The novel item is constructed by first preparing the pictorial message and then die-cutting it in a particular manner where there are at least three identical sections which meet at the geometric center of the item. After die-cutting, rearrangement of a majority of the pieces is carried out in order to scramble the message, and the scrambled visual image is then printed upon sheet material which is die-cut so as to fabricate the item in its scrambled message form. The presentation of the assembled, interfitted pieces which portray a scrambled message has been found to have a unique attraction to the recipient in exiting his curiousity to reassemble the scrambled pieces, and in so doing, the hidden message becomes uniquely conveyed to the recipient.

Various other features and advantages of the invention will become apparent from the following detailed description of several preferred embodiments of promotional items, particularly when read in conjunction with the accompanying drawings wherein.

Figure 1:
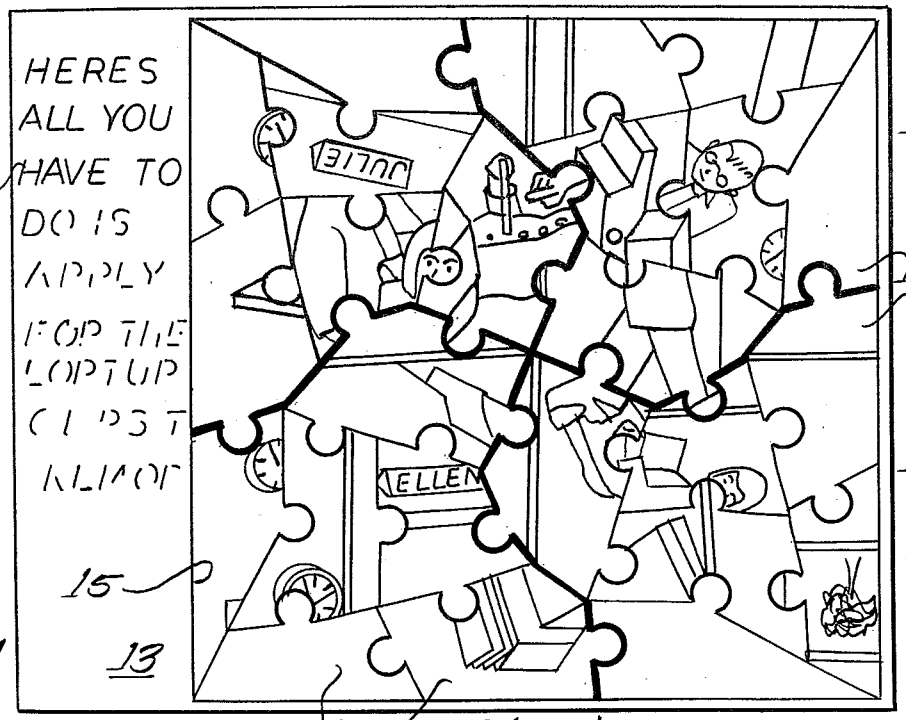
FIG. 1 is a plan view of an item embodying various features of the invention, showing it in the scrambled-message form in which it would be fabricated and distributed.

FIG. 1 illustrates a promotional or advertising item 11 which is rectangular in shape, more particularly square, and includes a peripheral frame 13. The message-bearing portion 15 of the item is divided into a plurality of separate pieces 17 which are assembled together so as to totally cover the continuous region interior of the frame 13. As can be seen from FIG. 1, the pieces 17 interfit with one another to provide complete, unbroken coverage, yet in the illustrated arrangement, they provide an incomprehensible visual or pictorial message. For purposes of this application, interfitting pieces are defined as including pieces that lock together (as shown) so as to prevent them from being slid apart without being lifted and disengaged as well as those of different shapes and/or sizes which merely abut side-by-side, but excluding pieces that all have the same shape, such as regular polygons (e.g., triangles, squares, and hexagons), rectangles or the like.

Figure 2:
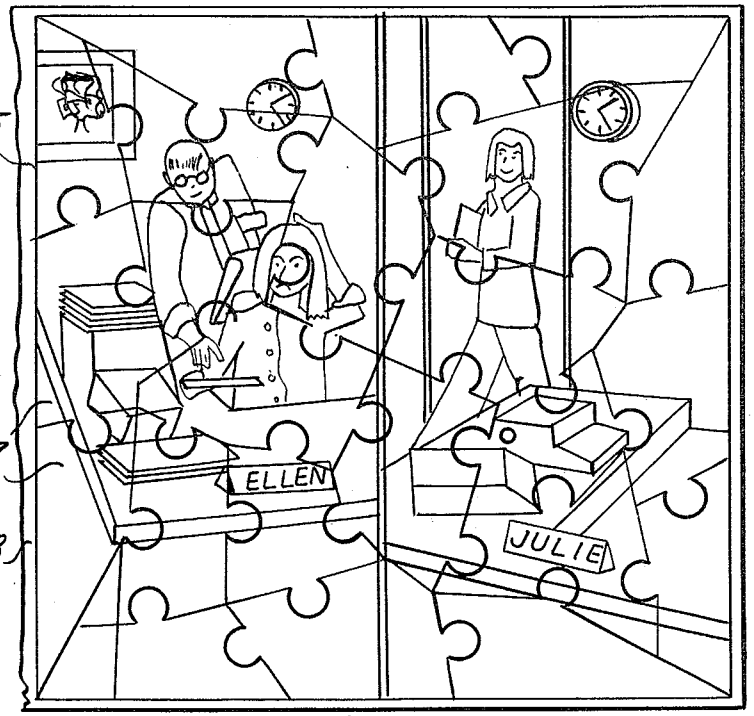
FIG. 2 is a view similar to FIG. 1 showing the item in its reassembled form wherein the message is comprehensible.

The preferred method of making the item is to divide the message-bearing portion 15 into three or more sections 19 of the identical peripheral shape, which sections each extend inward from the periphery to the geometric center of the picture. In the item illustrated, the overall picture is divided into four identical sections or quadrants 19 which are indicated in bold outline in both FIGS. 1 and 2. In the illustrated embodiment, each of the quadrants 19 includes six identical pieces; however, it should be understood that each quadrant could be broken up into any desired number of pieces so long as all four quadrants are cut in precisely the same manner.

Preferably, as shown in FIG. 1, each of the pieces 17 of a particular quadrant has a different shape, Therefore, each individual piece can be placed in any of four different locations throughout the picture, i.e., at the same relative location within each of the four quadrants 19. However, only when each piece is in one specific location will the correct solution be achieved and the message be fully comprehensible.

The advertising or promotional item 11 can be fabricated from any suitable type of sheet material which can be cut into individual pieces. For example, the pictorial message may be printed directly on heavy paper or light fiberboard, such as cardboard, or upon suitable plastic sheeting. Alternatively, it can be manufactured in the way of normal jigsaw puzzles by printing the pictorial representation on a thin sheet of paper or the like which is laminated to a thicker backing material, such as chip board.

The pictorial message is first suitably composed photographically, artistically or the like and the pattern for die-cutting is then created. As earlier indicated, the overall region 15 of the pictorial representation is divided into a plurality of identical sections, for example, four quadrants 19, which meet at the geometric center of the region. The message-bearing pictorial representation is then cut using this pattern, and the individual pieces 17 are then arranged so as to scramble the message by moving at least a majority of the pieces from their original locations and relocating them in a different quadrant. Preferably, substantially all of the pieces are moved from their original locations so as to make more difficult the task of discerning the message which the item bears. Thereafter, printing onto the desired sheet material is carried out with the pieces 17 arranged in this scrambled array, as shown in FIG. 1, as by a suitable photolithographic process or the like. Thereafter, die-cutting in the predetermined pattern effects mass production of the advertising or promotional items 11 ready for distribution with the pictorial message in its scrambled array.

If the interfitting pieces 17 are not designed to interlock with one another, then the die-cutting is usually interrupted at spaced intervals, as by providing small nicks at spaced locations in the die, so as to leave easily tearable or rupturable points of attachment between adjacent pieces. These points of joinder can be easily broken by the recipient to permit the rearrangement to discover the hidden message but assure the maintenance of the integrity of the item during distribution, and it is important to leave such points of joinder whenever the item is die-cut from relatively thin sheet material. If the item 11 includes an outer frame 13 about the pictorial message, points of attachment are likewise left between the frame and the peripheral pieces. Preferably, the frame 13 is printed with a suitable instruction or announcement 21 which explains the promotion and tells the recipient what action to take. Alternatively, the item could be a children's menu with the announcement 21 being the list of children's meals that are available.

On the other hand, if the pieces of the puzzle are designed so as to interlock with one another, fewer points of interconnection between pieces may be needed to assure integrity throughout distribution, dependent of course upon the sheet material from which the item is made. Moreover, the frame 13 may have a second layer laminated to its underside which supports the pieces in tray-like fashion and which might obviate the need for any such interconnections between pieces.

Figure 3:
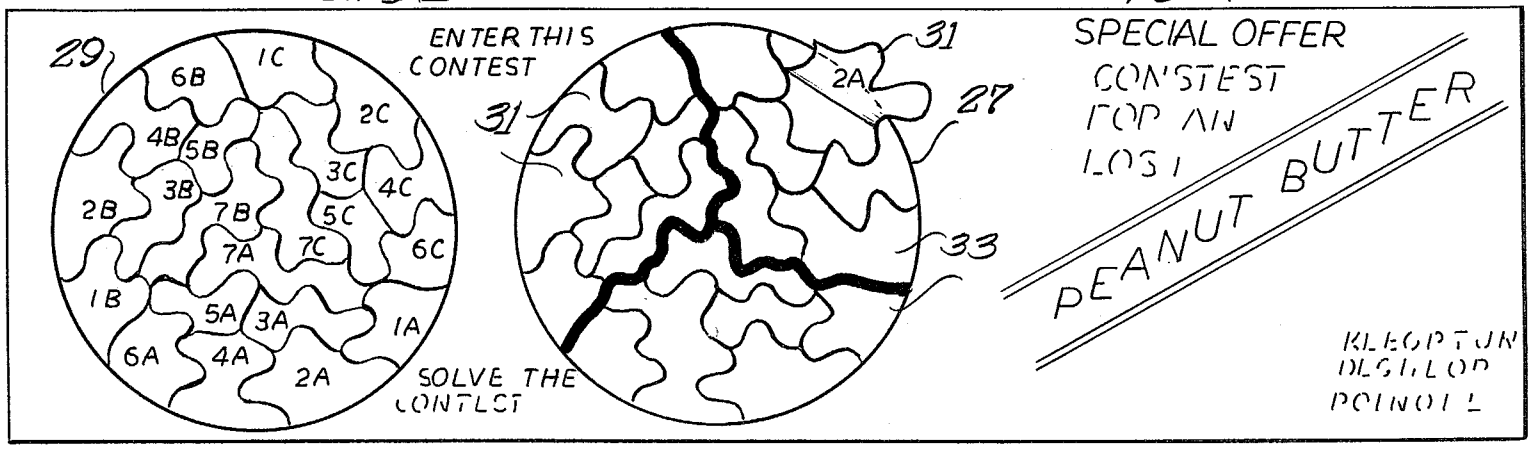
FIG. 3 shows a label for a jar which incorporates alternative embodiment of the invention.

An alternative embodiment is shown in FIG. 3 wherein an item 25 is depicted which is designed for applying as a label to the outside of a container. The illustrated label 25 is designed for attachment to the cylindrical surface of a jar, such as those within which peanut butter is usually sold, or to a bottle or a can; however, it could also be attached to a package of square or rectangular cross section. The label 25 is broken up into three areas with the main or front area constituting that for the product identification and description and with the remaining two areas being used for the promotional or advertising feature. In this embodiment, the scrambled message is contained within a circular perimeter 27 and a second circular outline 29 of the same size is provided in the adjacent region to the left thereof.

The label 25 is made of a lamination of two sheets which are held together by a pressure-sensitive adhesive at least in the area 27; conventional adhesive could be used throughout the remainder of the label. The top sheet is die-cut in the circular area 27 to form a plurality of interfitting pieces 31. The undersurface of the top sheet of the lamination in the area of the die-cut pieces 31 carries the layer of pressure-sensitive adhesive, and the upper surface of the lower sheet in this region is coated with a release coating, e.g., a silicone, so that the separate pieces 31 can be individually peeled off. The peeled-off pieces will carry the layer of pressure-sensitive adhesive on their undersurface, and this adhesive backing allows the piece to be relocated within the adjacent circular outline 29 provided for this purpose. If desired, the upper surface of the adjacent circular outline can be provided with a similar release coating so that the pieces may be easily shifted if their original placement should be in error.

Preferably, the adjacent circular outline 29 is also provided with an outline of all of the individual pieces which in this instance are arranged in three identical regions 33 of seven pieces each. Each piece in one region 33 differs in shape from every other piece, and thus each piece 31 will have three possible resting places. By outlining all of the shapes of the pieces 31 in the circular area 29, rearrangement to create the hidden message at this spaced location is facilitated. Should it be desired to make achievement of the proper rearrangement with the adhesivebacked pieces more challenging, the outlines of the separate pieces can be omitted from the area 29.

Should it be desired to further facilitate the appropriate assembly of the pieces, the outlines of the individual spaces in the circular region 29 can be consecutively numbered, as illustrated. These numbers are arranged to match numbers associated with the individual die-cut pieces 31 that constitute the top layer of area 27. The pieces 31 may carry a number on their undersurface, as illustrated, which is visible through the transparent layer of pressure-sensitive adhesive. Alternatively, the number could be provided on the lower layer so that it will become visible as soon as the piece has been peeled from its original location, or the number could be printed in small type in an inconspicuous place on the upper surface of each piece. The number directs the recipient to place the piece 31 in the appropriately numbered space on the adjacent circular area 29 and is thus of great assistance to small children. Thus, in this arrangement, the promotional device is visible to the consumer and not only provides a reason for purchasing the product, but can be linked with an appropriate offer—for instance the solving of the puzzle to learn the hidden message qualifies the recipient for some type of contest or promotion.

Although the invention has been described with regard to two preferred embodiments, it should be understood that various changes and modifications as would be obvious to one having the ordinary skill in this art may be made without deviating from the scope of the invention which is defined solely by the claims appended hereto. For example, instead of having the sections extend precisely to the geometric center of the area, a single piece could be left at the center which would interfit with the centermost pieces from the four quadrants, for example. Such a piece could also be made symmetrical so that it could be originally arranged in upsidedown orientation, requiring it to be turned 180° in order to have it in the proper position for determining the hidden message.

Moreover, although the use of sections which are identical has a number of advantages, this is not a prerequisite to obtaining the promotional or advertising advantage of an item that incorporates such a hidden message. To deviate from identical sections, several of the pieces 17 of the item illustrated in FIGS. 1 and 2 could be divided into two pieces in two of the quadrants, while leaving the pieces of the other two quadrants unchanged. Alternatively, two pieces from one quadrant could be combined into a single piece without changing the other three quadrants. Such modifications would leave the quadrants substantially identical and thus not affect the overall character of the item.

Other die-cutting schemes can also be developed wherein, for example, two of the quadrants are identical while the other two quadrants are different from these two but also identical with each other. Then, by providing in such an arrangement a number of pieces which are common to all four quadrants, those common pieces would each have four prospective locations whereas the remaining pieces would each have only two prospective locations in rearranging the scrambled pieces to discover the hidden message. Thus, although there are significant advantages to be gained from a manufacturing standpoint in employing identical or substantially identical sections, it must be recognized that other arrangements wherein nearly all of the pieces have at least two prospective locations and at least a third of the pieces have more than two prospective locations will allow the message to be effectively hidden.

A written message might also be printed upon the opposite surface of the item in the region where the die-cutting will be effected. This written message will thus be comprehensible when the item is distributed but will become scrambled as the puzzle is solved to learn the hidden message. Should it be desired it omit the frame portion of the item, the written message printed upon the opposite surface could be the announcement or instructions.

A panel of a cardboard box, for example, the rear wall of a breakfast food package, could be die-cut to produce the scrambled message, in which case the remainder of the panel would function as the frame and carry the instructions or explanation. Alternatively, a die-cut sheet could be laminated to a box panel, in a region that carries a release coating, using a pressure-sensitive adhesive.

Various of the features of the invention are set forth in the claims which follow.

What is claimed is:

1. An advertising or promotional item comprising a frame, which frame carries an announcement in one portion thereof, and a plurality of separate interfitting pieces of irregular shape formed within another portion bounded by said frame and formed of a lamination of upper and lower sheet material layers, which pieces are formed as a part of said upper layer and are arranged in a first interfitting relationship which totally occupies said other portion within said frame, said lower layer including a release coating and said pieces being held thereto by a pressure-sensitive adhesive.

substantially all of said pieces each having the same irregular shape as at least one other piece so that it can be interchanged in location with said other piece, said pieces when rearranged to a second predetermined interfitting relationship which also totally occupies said other portion within said frame presenting an intended advertising or promotional message, said pieces being printed and formed in said first relationship wherein the message is scrambled so that recipients of the item must rearrange the scrambled pieces to discover the hidden message which relates directly to said announcement, and still another portion of said frame being provided with indicia including an outline of the shape of said pieces and with a release coating to which said pieces can be releasably adhered.

2. An item in accordance with claim 1 wherein a product identification is carried by a further portion of said frame so that said item is designed to serve as a label and be affixed to the exterior of a package.

3. A label in accordance with claim 2 wherein said indicia also includes a different reference designation for each piece and wherein each piece is provided with a matching designation on the rear surface thereof which designation indicates the proper location of said piece in said predetermined second relationship.

* * * * *